US005613482A

United States Patent [19]

Thai et al.

[11] Patent Number: 5,613,482

[45] Date of Patent: Mar. 25, 1997

[54] DISK SHOOTING TOY GUN

[76] Inventors: Douglas Thai; Dinh Thai, both of 19907 Tennessee Trail, Walnut, Calif. 91789

[21] Appl. No.: 379,366

[22] Filed: Jan. 27, 1995

[51] Int. Cl.[6] ..... F41B 7/00; F41B 7/08

[52] U.S. Cl. ..... 124/16; 124/27

[58] Field of Search ..... 124/16, 26, 27, 124/31, 37, 45, 46, 52, 81

[56] References Cited

U.S. PATENT DOCUMENTS

| | | | |
|---|---|---|---|
| 329,211 | 10/1885 | Raub | 124/46 X |
| 858,895 | 7/1907 | McCloud | 124/26 |
| 1,024,374 | 4/1912 | Stambaugh | 124/21 |
| 1,261,992 | 4/1918 | Algie | 124/21 |
| 2,019,894 | 11/1935 | Clauss | 124/42 X |
| 2,056,446 | 10/1936 | Dodge, Jr. | 124/21 |
| 2,458,828 | 1/1949 | Boese | 124/27 |
| 2,469,016 | 5/1949 | Stopper | 124/16 X |
| 2,562,462 | 7/1951 | Jackson | 124/52 |
| 2,742,889 | 4/1956 | Clauss | 124/26 |
| 2,825,324 | 3/1958 | Haas | 124/27 |
| 3,191,588 | 6/1965 | Thew | 124/31 X |
| 3,370,746 | 2/1968 | Haas | 124/16 X |
| 3,487,824 | 1/1970 | Profitt | 124/42 X |
| 3,515,111 | 6/1970 | Auge | 124/16 |
| 3,515,114 | 6/1970 | Carbonneau | 124/27 |
| 3,635,204 | 1/1972 | Plumb, Jr. | 124/16 |
| 3,717,136 | 2/1973 | Gay et al. | 124/21 |
| 4,059,089 | 11/1977 | Lehman | 124/27 |
| 4,170,215 | 10/1979 | Kettlestrings | 124/16 |
| 4,248,202 | 2/1981 | Jaworski et al. | 124/16 |
| 4,910,646 | 3/1990 | Kim | 362/112 |
| 5,199,410 | 4/1993 | Cheng | 124/16 X |

*Primary Examiner*—John A. Ricci
*Attorney, Agent, or Firm*—Price, Gess & Ubell

[57] ABSTRACT

A spring-powered toy gun ejects small disks, of the type children collect, giving the ejected disks a spin to improve their flight. The disks are first loaded into a separate spring-operated magazine which is then inserted into an aperture on the gun. A transparent window in the gun allows a user to view the magazine's top disk and any insignia thereon. The top of the magazine bears two retaining members that hold the top disk in place. These retaining members are spaced apart from the magazine by the thickness of one disk and, thus, set the thickness of the disks that can be fired from the gun. The top disk is ejected from the gun by a planar propulsion lever driven by a main spring. Pulling back on a trigger moves the main spring and the propulsion lever away from a rest position. When the trigger is pulled fully, the main spring is automatically released and snaps forward causing the propulsion lever to move forward and strike the top disk propelling it from the gun. Because the tip of the propulsion member is angled, it strikes the disk off-center imparting a spin to the disk.

12 Claims, 6 Drawing Sheets

FIG. 5
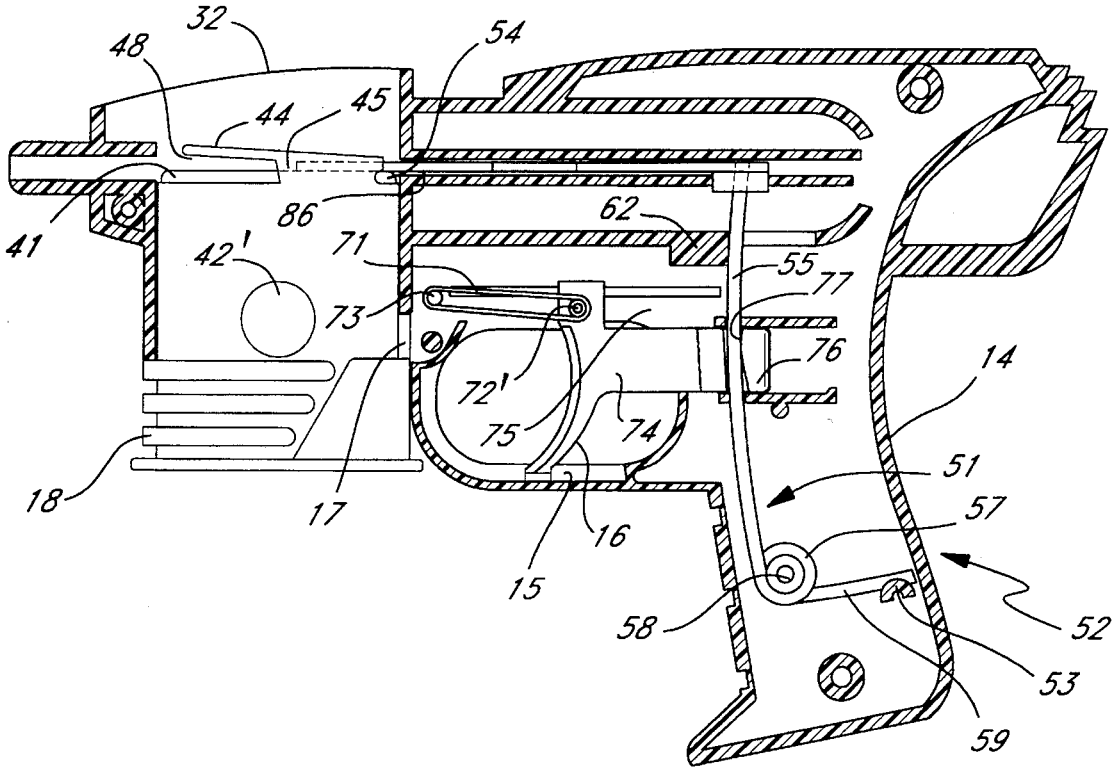
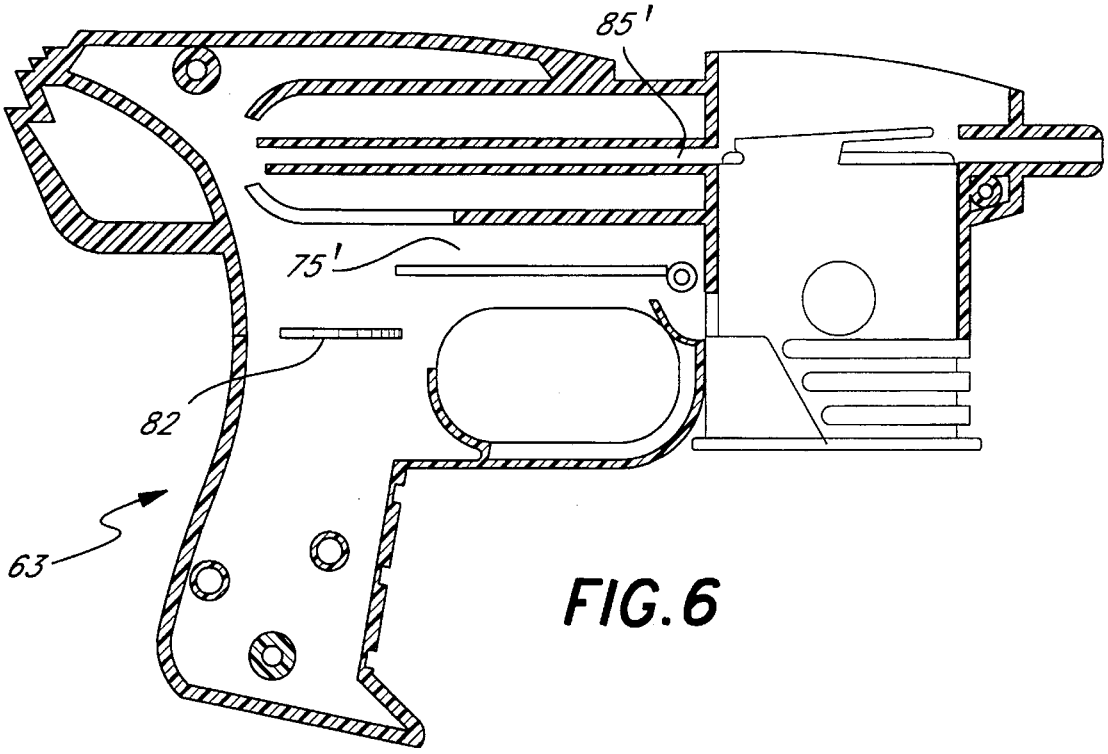
FIG. 6

DISK SHOOTING TOY GUN

BACKGROUND OF THE INVENTION

1. Field of the Invention

The present invention concerns the area of toy guns and, more specifically, a gun-like device that shoots substantially flat disks of the type that children collect and use to play games.

2. Description of Related Art

Much of children's play is actually made in imitation of adult activities and helps children learn to be adults. Favorite items of play are toy replicas of adult possessions, especially various tools that adults use in work and play. For example, cars, trucks, and other vehicles are favorite toy items, since adults spend so much time with these machines. In television programs and motion pictures and, to a lesser extent in real life, adults make extensive use of assorted weapons, especially guns. Therefore, toy guns and other weapons are highly favored as toys.

Because toys frequently emulate adult items, many toy guns closely imitate the features of real guns. Cap guns use a small charge of gun powder to produce both the sound and the smoke of real weapons. Other toy guns shoot some type of projectile. Play with these projectile-shooting toys is more exciting as the toys are actually capable of "shooting" something and games of marksmanship, etc. are possible.

Many projectile-shooting toy guns use pellets, darts, or similar projectiles. Because safety has become an increasingly important concern with toys, significant efforts have been expended to ensure that projectiles fired from toys do not injure an eye or cause similar physical damage. Generally, this means that the speed of the expelled projectiles should be kept low and that the projectiles be made of soft material and/or be generally too large to readily strike a child's eye (if the projectile is of sufficient diameter, the eye socket and the cheek bone will prevent the object from entering the eye).

There is often a conflict between safety and features that most children desire. Generally, the farther a projectile travels after being shot from a toy gun, the more children will enjoy the results. But safety demands often limit the speed with which projectiles leave the toys, limiting the distance the projectiles will travel.

One type of "safe" toy gun fires suction cup-tipped darts that are capable of sticking to a wall or target. Other toys avoid safety concerns by firing water rather than a solid projectile. Some toy guns shoot disk or ring-shaped projectiles. Generally disk-shaped projectiles can be made to travel at a relatively slow speed. This would tend to limit their distance of travel. However, if disk-shaped projectiles are given a rapid spinning motion as they leave a toy gun, they will tend to fly like a FRISBEE™ (disk-shaped "flying saucer" toy) and, hence, travel a considerable distance. Furthermore, disks are devoid of sharp points and can be made of a soft material and/or of a sufficiently large diameter to prevent direct entry into a child's eye.

Some disk-firing guns have been developed to propel spinning disks in a vertical orientation. Typical of this type is the disk gun disclosed in U.S. Pat. No. 3,487,824 to Profitt. In this device vertically oriented rings or disks are fed into a chamber from a spring-loaded magazine. A trigger-activated spring propels the disk from the barrel of the device, imparting a spin at the same time. The spin probably provides gyroscopic stabilization to the flying disk; however, spinning disks tend to fly farther, if oriented in a horizontal plane.

A toy gun that fires horizontally-oriented disks from a magazine is shown in U.S. Pat. No. 2,458,828 to Boese. However, this device does not impart a spin to the projectiles. Instead, it uses rather small disks that might constitute a safety hazard. U.S. Pat. No. 2,019,894 to Clauss uses larger disks that are given a spin to ensure significant periods of flight. The disks in this device are intended as advertisements and so bear attractive graphics. However, this device spins the disks by engaging the disk with a projecting member inserted through an eyelet in the disk. The eyelets tend to mar the overall appearance of the disks and complicate their manufacture. The device requires hand-loading of each disk possibly because the need to orient the disks so that they will be engaged by the projecting member complicates the construction of an auto-feeding magazine.

U.S. Pat. No. 3,515,114 to Carbonneau discloses a disk-firing toy gun in which the projectile disks are automatically fed into a firing position from a spring-loaded magazine integral with a lower portion of the gun. In the firing position, the disk can be expelled from the gun by being struck off center by a spring-driven plunger. The plunger propels the disk down a barrel which contains a guideway to keep the disk oriented horizontally. Because the plunger strikes the disk off center, a considerable spin is imparted to the disk, thus ensuring that the disk will fly a maximal distance after leaving the barrel.

This type of disk gun suffers from difficult disk loading since the integral magazine must be loaded by inserting the disks one at a time through a slot in the side of the gun. Also, since the magazine is integral to the gun, it is not possible to have preloaded magazines available to exchange for an emptied magazine. The guideways in the barrel of the gun also limit the gun to firing disks of a particular thickness; thicker disks will, of course, jam in the barrel.

Children also like to collect objects and to play games in which they show off their collections and possibly win additional items for the collection. The classic game of marbles operates in this manner. The children make collections of different marbles and then play a game in which they may win marbles from the other players. Baseball trading cards are another extremely popular collectible. Baseball cards take advantage of the popularity of sports heroes and their teams. The cards show players and team logos. Children collect and trade these cards, but there is not really a universal game played with the cards. Other types of trading cards that show other sports figures or even fictional heroes are also quite popular.

Recently, a new type of collectible with some of the properties of both trading cards and marbles has appeared. Paper or plastic disks with various insignias or logos are collected. In addition, a game is played in which a special heavier disk often called a "slammer" is launched into a pile of the regular disks. Depending on how the disks land after being scattered the owner of the slammer may also win some or all of the disks.

The popularity of the collectable disks is already spreading across the country. If other play uses for the disks could be developed, their overall popularity would be augmented. One possibility is a toy gun that is capable of shooting the disks. Thus, children could play target and other games with their disk collections. If the gun could also accommodate the thicker and heavier "slammers," then the classic disk game could also be played by shooting a slammer into the pile of disks. Since the insignia on the disks are central to their collectability, it would also be highly desirable if the disk gun were constructed in such a way that the insignia on each disk could be readily determined before the disk was shot from the gun.

OBJECTS AND SUMMARY OF THE INVENTION

It is an object of the present invention to provide a simple toy gun capable of firing collectible disks;

It is a further object of the present invention that the gun impart a spin to the fired disks so that they will fly for a considerable distance;

It is another object of the present invention to provide a disk gun that accepts preloaded magazines so that the gun can be rapidly loaded with a number of disks;

It is also an object of the present invention to provide a method to readily view the insignia on the disk next to be fired from the gun; and It is a further object of the present invention to provide a gun that is capable of adaption to disks of various thicknesses so that thicker slammer disks may also be shot from the gun.

These and other objects are met by a spring-powered toy gun that ejects small disks, of the type children collect, imparting a spin on the disk to improve its flight. The disks are first loaded into a separate spring-operated magazine which is then inserted into an aperture on the gun. A transparent window in the gun allows a user to view the magazine's top disk and any insignia thereon. The top of the magazine bears two retaining members that hold the top disk in place. These retaining members are spaced apart from the magazine by the thickness of one disk and, thus, determine the thickness of the disks that can be fired from the gun. The top disk is propelled from the gun by a planar propulsion lever driven by a main spring. Pulling back on a trigger moves the main spring and the propulsion lever away from a rest position. When the trigger is fully pulled, the main spring is automatically released and snaps forward, causing the propulsion lever to move forward and strike the top disk, propelling it from the gun. Because the tip of the propulsion lever is angled, it strikes the disk off-center, imparting a spin to the disk.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 5 shows a cross-sectional view through the gun of FIG. 1 illustrating the right-hand half;

FIG. 6 shows a cross-sectional view through the gun of FIG. 1 illustrating the left-hand half;

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a toy gun that fires disks from preloaded magazines, the gun being designed to impart a spin to each disk while expelling it and having a transparent region disposed to allow observation of an insignia on the disk before the disk is shot from the gun.

Figure 1:
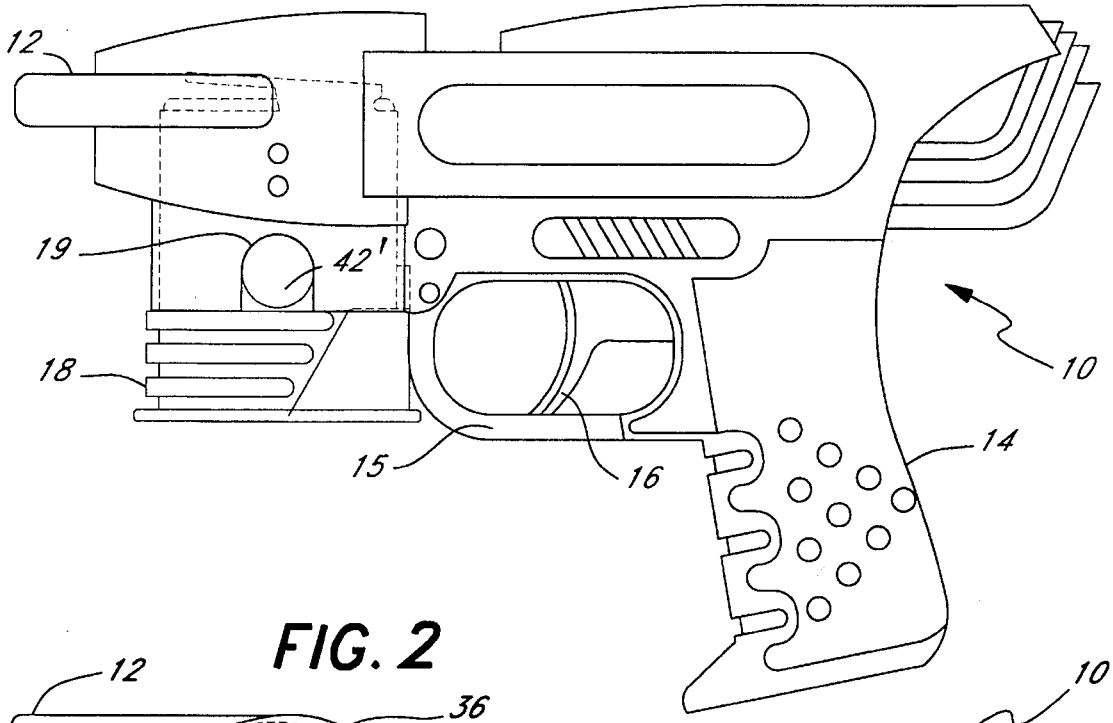
FIG. 1 shows an elevational view of the left hand side of the gun of the present invention.

FIG. 1 shows an elevational view of the left-hand side of the toy gun 10 of the present invention. The gun 10 consists of two halves (see FIGS. 5 and 6) molded from a plastic material by conventional techniques. The gun 10 has a barrel 12 and a typical gun handle 14. A trigger 16 is surrounded by a trigger guard 15. A removable magazine 18 is inserted into the gun 10 from below.

Figure 2:
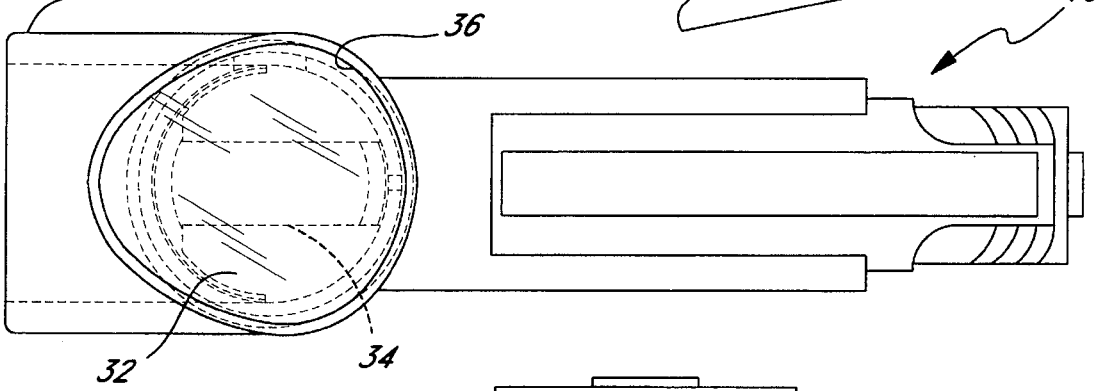
FIG. 2 shows the gun of FIG. 1 from above.

FIG. 2 shows the gun 10 from above. A large transparent port 32 reveals a top surface 34 of the magazine 18. If a plurality of disks is loaded into the magazine 18, any insignia on the top disk will be visible through the port 32. The port 32 can conveniently be made from acrylic or any suitable transparent plastic shaped to fit an opening 36 in the gun 10. Alternatively, the entire gun 10 can be molded from a suitable transparent plastic, in which case the port 32 would simply be a continuation of the gun material. The remainder of the gun 10 can then be painted with opaque paints so that the interior mechanism will not be visible.

Figure 3:
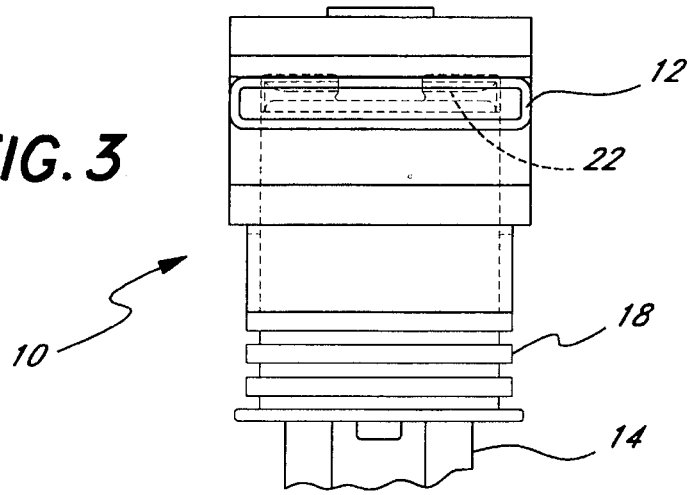
FIG. 3 shows a view of the gun of FIG. 1 looking down the barrel of the gun.

FIG. 3 shows a view of the gun 10 taken looking down the barrel 12. The barrel 12 has a slot-like opening 22. The vertical dimension of opening 22 is greater than the thickest disk which the gun can fire.

Figure 4A:
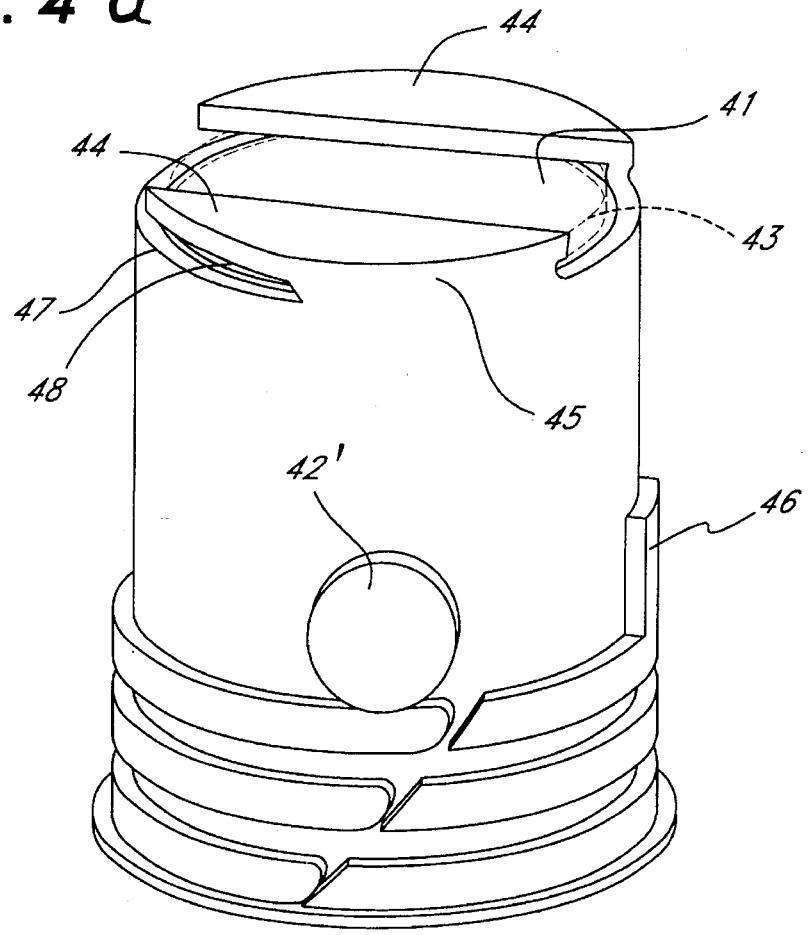
FIG. 4*a* shows an elevational view of a magazine used with the gun of the present invention.
Figure 4B:
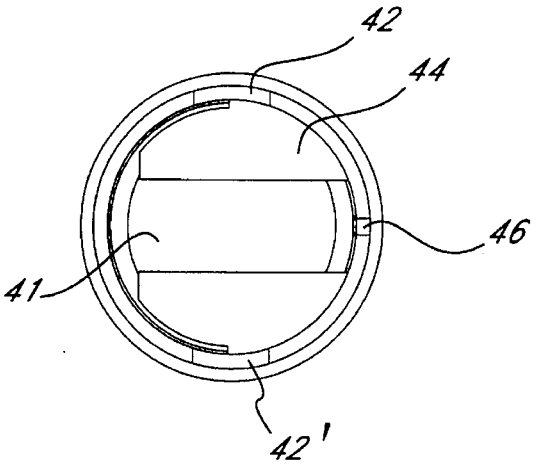
FIG. 4*b* shows a top view of the magazine of FIG. 4*a;*
Figure 4C:
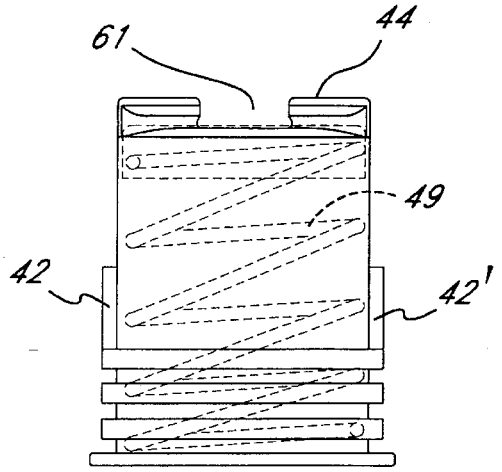
FIG. 4*c* shows a cross-sectional view of the magazine of FIG. 4*a;*

FIG. 4*a* shows an elevational view of the magazine 18. The magazine 18 is cylindrical in shape. Projections 42 (see FIG. 4*b*) and 42' are on opposite sides of the magazine and interact with notches 19 on the gun 10 when the magazine 18 is inserted into the gun 10. The magazine 18 is hollow to accommodate a stack of disks. A spring 49 (see FIG. 4c) biases a traveler piston 41 which pushes the stack up as a top disk 43 (shown in dotted line) is expelled from the gun 10. The magazine 18 is loaded by sliding disks, one at a time, under retainers 44 from the front of the magazine. Edges of the traveler piston 41 can be chamfered to aid in the loading process. A pathway 61 between the retainers 44 is provided to allow viewing of the top disk 43 and to accommodate a propulsion mechanism as explained below. Each disk added to the stack depresses the traveler piston 41 until it reaches the bottom of its travel, at which point the magazine is fully loaded.

The rear of the magazine 19 is defined by a projection 46 which engages a complementary notch 17 on the gun 10, thereby ensuring that the magazine 18 is inserted into the gun 10 in the correct orientation with the spacers 45 facing towards the rear of the gun 10. The top disk 43 of the stack is held in place by retainers 44. The retainers 44 are angled up slightly towards the from of the magazine 18 to facilitate loading disks and to ensure that the top disk 43 will not strike a top edge 47 of the magazine 18 when it is fired from the gun 10. The retainers 44 are attached to the magazine 18 by spacers 45 which space apart the retainers 44 from the top edge 47 of the magazine 18. A firing chamber 48 is formed between the top edge 47 and the retainer 44. The height of this firing chamber 48 is approximately equal to the thickness of the disk to be fired from the gun 10.

The thickness of the disks shot by the gun 10 is controlled by two parameters: first, the height of the barrel opening 22 sets an absolute maximum thickness; and second, the firing chamber 48 between the retainers 44 and the top edge 47 of the magazine 18 sets the effective thickness. Thus, disks of any thickness less than or equal to the height of the barrel slot 22 can be accommodated by adjusting the firing chamber 48 accordingly. This can be accomplished by providing multiple magazines with several different sized firing chambers. Alternatively, the firing chamber 48 on a single magazine can be made adjustable so that different chamber sizes and, hence, different disk thicknesses, can be selected.

FIG. 5 shows a cross-section through the right-hand half 52 of the gun 10 with the inserted magazine 18. The gun 10 is in a rest position. A propulsion lever 54 is a substantially flat, elongate piece with an elongate hole 56 (see FIG. 11 ) in an end opposite the end which projects into the firing chamber 48. A metal wire main spring 51 comprising a first straight portion 55 which passes through the hole 56, a wound portion 57 which is placed over a peg 58, and a second straight portion 59 which abuts a post 53, thereby tensioning the main spring 51.

In the rest position, as shown in FIG. 5, the main spring 51 is under tension and presses against a spring retainer 62 which is molded into the right-hand half 52 of the gun 10. When the main spring 51 rests against the spring retainer 62, the propulsion lever 54 is in its maximum forward position projecting into the area that is occupied by the firing chamber 48 when the magazine 18 is inserted into the gun 10. However, the hole 56 that forms the connection between the main spring 51 and the propulsion lever 54 is large enough to allow the propulsion lever 54 to pivot up and down relative to the main spring 51. Therefore, when the magazine 18 that is inserted into the gun 10 is loaded with disks, the top disk 43 presses the end of the propulsion lever 54 up into the pathway 61 and out of the way (see FIG. 7).

The trigger 16 can slide backward and forward on posts 72, 72' which ride in guide grooves 75 and 75' (see FIG. 6). A trigger return band 71 is a heavy rubber band that connects the trigger post 72' to a return post 73 molded into the right half 52 of the gun 10 and provides a forward bias to the trigger 16. A cocking lever 74 is integral with the trigger 16. A rearward projection 76 of the cocking lever 74 is considerably thickened. A notch 78 is cut into this thickened rearward projection 76.

In the rest position the return band 71 attempts to pull the trigger 16 forward. This forward motion is prevented by an edge 77 of the notch 78 which intersects the main spring 51 and holds the trigger 16 stationary. As a user pulls backward on the trigger 16, the cocking lever 74 moves rearward until an opposite edge 79 of the notch 78 intersects the main spring 51 (see FIG. 8). The main spring 51 is then moved rearward by the edge 79. As the main spring 51 moves rearward, so does the propulsion lever 54. As soon as the propulsion lever 54 is moved out of the firing chamber 48, the propulsion lever 54 is no longer pushed up by the top disk 43. The propulsion lever 54 pivots downward to line up with the side edge of the top disk 43.

Figure 12:
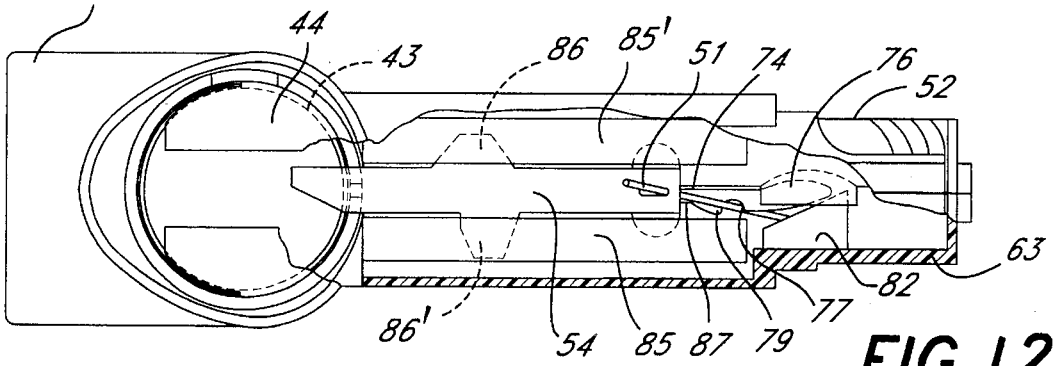
FIG. 12 shows a top cutaway view of the invention.
Figure 13:
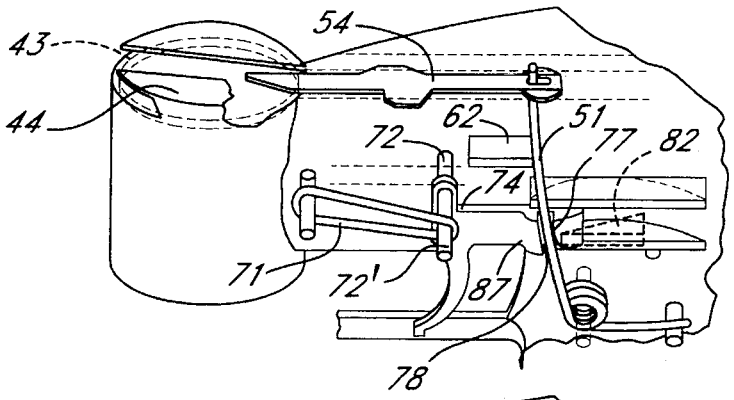
FIG. 13 is a cutaway view from the side showing the trigger at rest.
Figure 14:
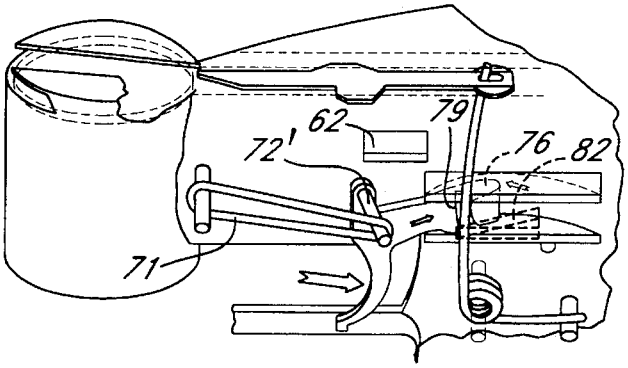
FIG. 14 is a cutaway view from the side showing the trigger being pulled and the cocking lever moving the main spring.
Figure 15:
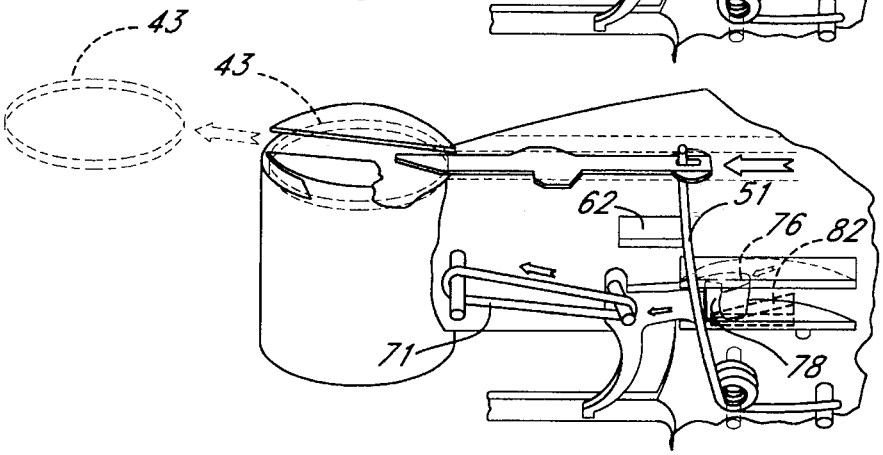
FIG. 15 is a cutaway view from the side showing the main spring released from the cocking lever and the propulsion lever striking the disk in the firing chamber.

As is more clearly displayed in FIGS. 12 and 13, the entire cocking lever 74 is canted towards the main spring 51 (up, out of the paper in FIG. 13) by the trigger return band 71. This keeps the main spring 51 firmly in the notch 78. As the cocking lever 74 is moved rearward displacing the main spring 51 (FIG. 14), the propulsion lever 54 is pulled backwards. The thickened projection 76 contacts an inclined plane 82 molded into the left-hand half 63 of the gun 10 (see FIG. 6). As shown in FIG. 14, this interaction overcomes the canting of the cocking lever 74 which now moves away from the main spring 51 (upward in FIG. 12). This releases the main spring 51 from the notch 78, allowing the spring 51 to snap forward until it contact the spring retainer 62. This action (FIG. 15) carries the propulsion lever 54 forward to strike the top disk 43 and expel it from the gun 10.

Figure 11:
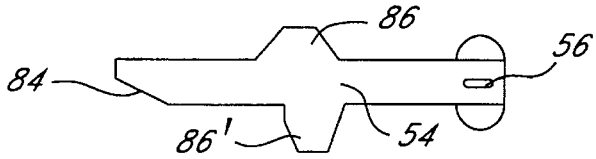
FIG. 11 shows a propulsion lever of the gun of the present invention.

The propulsion lever has wings 86 and 86' which ride in guide grooves 85 and 85' on the right-hand 52 and left-hand 63 halves of the gun 10, respectively. As shown in FIG. 11, an end 84 of the propulsion lever 54 is angled so that the top disk 43 is struck somewhat off-center, thus imparting the desired spin to the expelled disk.

When the user releases the trigger 16, it snaps forward under the urging of return band 71, and the main spring 51 once more becomes captured by the notch 78. This recapture is facilitated by an inclined plane 87 on the left-hand side of cocking lever 74 which allows the main spring 51 to slip along the cocking lever 74 and snap back into the notch 78. This action returns the gun 10 to the rest position ready to repeat the cycle and expel the next disk from the magazine 18.

Figure 7:
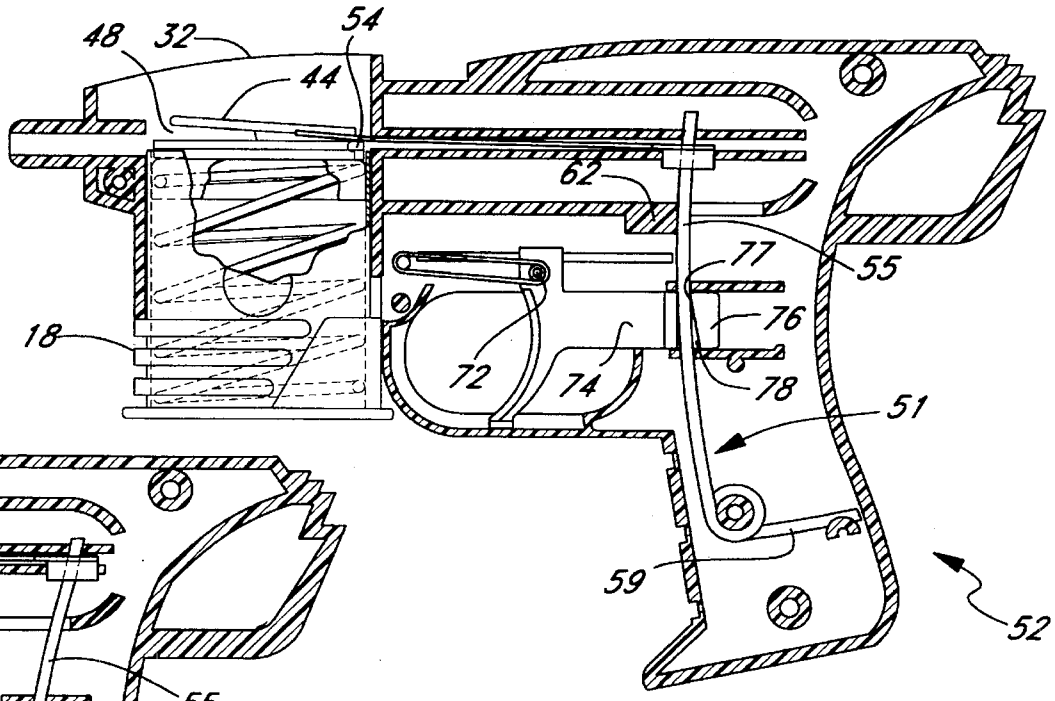
FIG. 7 shows a cross-sectional view illustrating the gun at a rest position.

In summary, the propulsion lever 54, which is intended to eject disks from the firing chamber 48, extends into the region of the firing chamber 48 when the gun 10 is in the rest position. As shown in FIG. 7, when a loaded magazine 18 is inserted, the propulsion lever 54 is pushed up by the top disk 43. The pathway 61 between the retainers 44 accommodates the propulsion lever 54.

Figure 8:
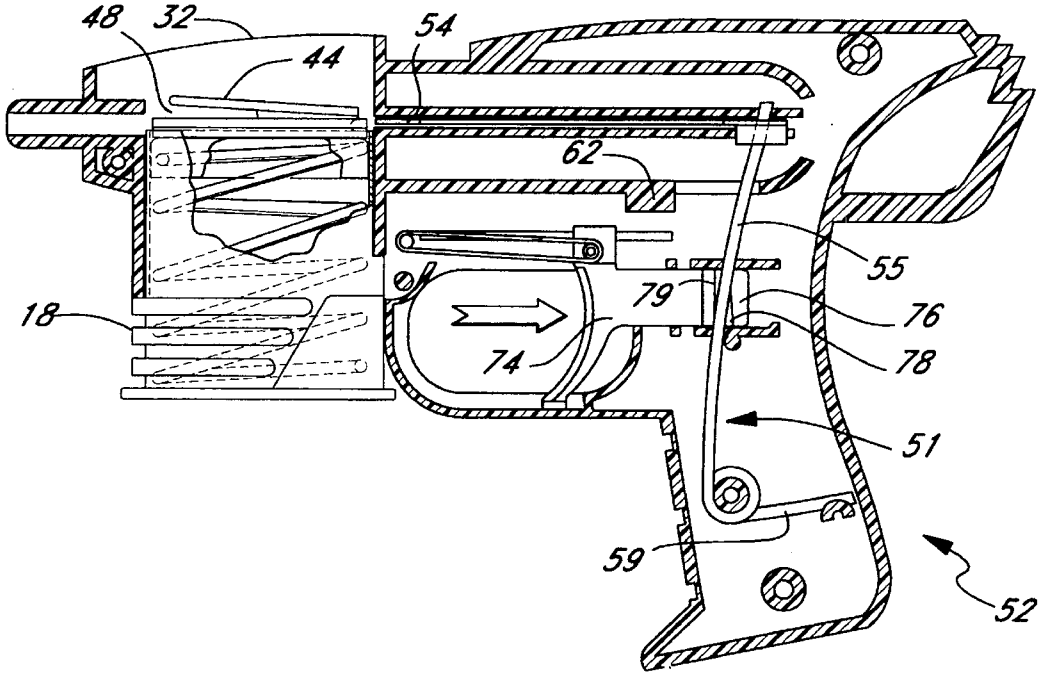
FIG. 8 shows a cross-sectional view similar to FIG. 7 with the trigger maximally pulled.

As shown in FIG. 8, pulling the trigger 16 causes the main spring 51, captured by the notch 78, and the propulsion lever 54 to move rearward. When the propulsion lever 54 clears the top disk 43, the propulsion lever 54 drops down to be in line with the side edge of the top disk 43 in the pathway 61 between the two retainers 44.

Figure 9:
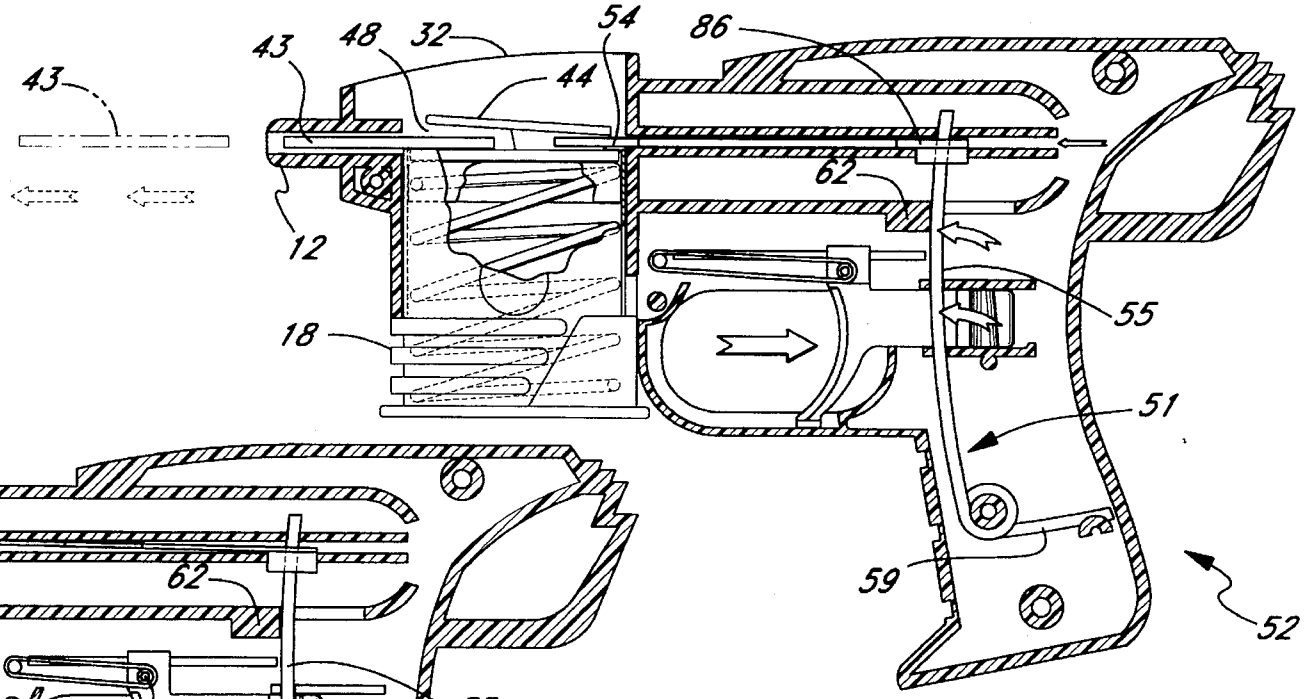
FIG. 9 shows a cross-sectional view similar to FIG. 8 with the main spring released from the cocking lever and the propulsion lever expelling a disk.

FIG. 9 shows what happens when the cocking lever 74 reaches the inclined plane 82, and the cocking lever is pressed to the side, releasing the main spring 51 from the notch. The main spring 51 moves forward rapidly until it strikes the spring retainer 62. At the same time the propulsion lever 54 shoots forward, striking the side edge of the top disk 43 and ejecting it spinning from the firing chamber 48 and out through the opening 22 of the barrel 12.

Figure 10:
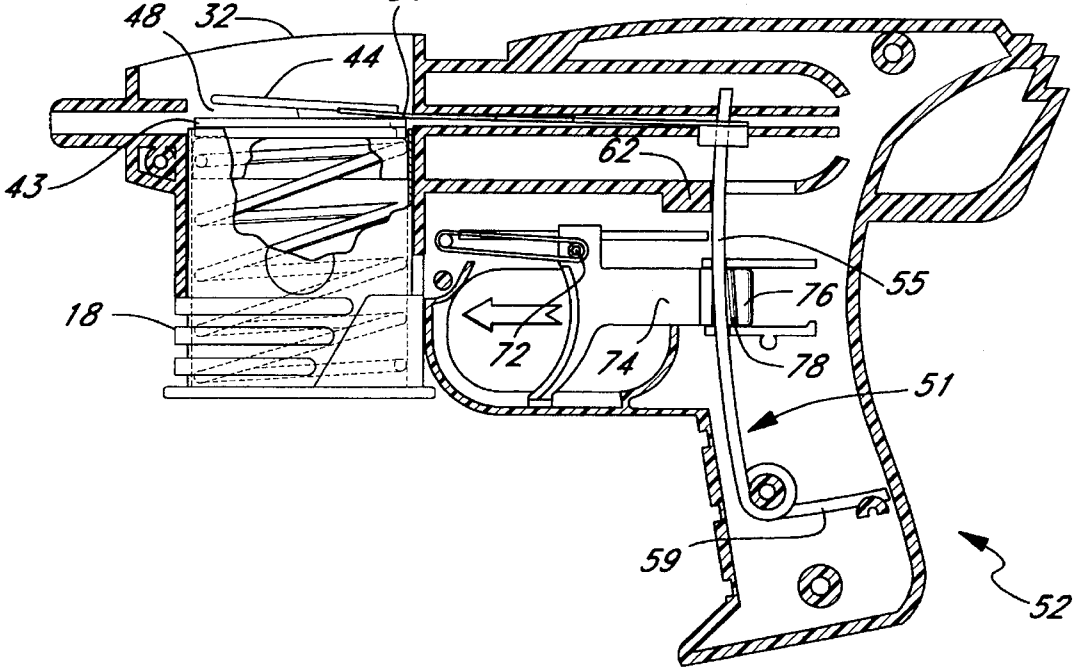
FIG. 10 shows a cross-sectional view similar to FIG. 9 with the trigger and cocking lever returning to a forward rest position.

When the trigger 16 is released as in FIG. 10, the cocking lever 74 is moved forward by return band 71 and the main spring again is captured in the notch 78. At the same time, the traveler piston 41 moves another disk 43 into the firing chamber 48. The entire cycle then repeats.

Those skilled in the art will appreciate that various adaptations and modifications of the just-described preferred embodiment can be configured without departing from the scope and spirit of the invention. Therefore, it is to be understood that, within the scope of the appended claims, the invention may be practiced.

What is claimed is:

1. A toy gun for propelling disk-shaped projectiles of varying thicknesses, the gun comprising:

a hollow gun body of a gun-like shape having a barrel with an open end and a handle for grasping the gun forming approximately a right angle with the barrel;

a removable magazine for sequentially dispensing a plurality of disk-shaped projectiles into the gun, the magazine sized to fit and insertable into an aperture in the gun body, the removable magazine comprising:

a hollow magazine body having a closed end and an open end;

a firing chamber formed between the open end of the magazine body and a planar retainer member retaining said disk-shaped projectiles in said magazine, said planar retainer member attached to the open end and spaced a distance apart from the open end, the maximum thickness of the disk-shaped projectiles defined by the distance between the retainer member and the open end, the planar retainer member coveting only edge portions of the disk-shaped projectile;

a traveler piston within the magazine body for moving a top projectile of a stack of the projectiles into the firing chamber; and a spring between the closed end of the magazine body and the traveler piston for pushing the traveler piston;

a transparent window fixedly mounted to the gun body at an upper surface of the barrel to allow a user to view a major portion of the top projectile in the firing chamber, said transparent window positioned over said magazine and sized to be larger than the projectile's exposed surface area such that the entire projectile can be seen through the transparent window except for the portions of the projectile covered by the planar retaining member;

a propulsion lever disposed to strike a side edge of the top projectile for expelling the top projectile from the firing chamber, an end of the propulsion lever which strikes the edge of the projectile being angled for imparting a spin to the top projectile;

a main spring disposed within the body and engaging the propulsion lever for moving the propulsion lever towards the top projectile;

a trigger depending from the gun body in a position to be pulled by a finger of a hand grasping the handle of the body;

a cocking lever operationally connected to the trigger and capturing the main spring within a notch of the cocking lever for moving the main spring and the engaged propulsion lever rearward away from the magazine when the trigger is pulled; and an inclined plane attached to an interior surface of the gun body for releasing the main spring from the notch by displacing the cocking lever, thereby causing the main spring and the propulsion lever to move rapidly forward towards the magazine, the propulsion lever striking the top projectile in the firing chamber, propelling it spinning from the open end of the barrel.

2. A toy gun for propelling disk-shaped projectiles, the gun comprising:

a hollow gun body having a barrel with an open end and a handle for grasping the gun;

a magazine removably attachable to the gun for sequentially dispensing disk-shaped projectiles into the gun;

a firing chamber occupied by a disk-shaped top projectile when a loaded magazine is attached to the gun, dimensions of said firing chamber defined by said magazine and setting the maximum size of the top projectile and leaving a central portion of the top projectile uncovered;

a transparent window fixedly mounted to the gun body at an upper surface of the barrel to allow a user to view a major portion of the top projectile in the firing chambers, said transparent window positioned over said magazine and sized to be larger than the projectile's exposed surface area such that the entire projectile can be seen through the transparent window except for the portions of the projectile covered by the magazine;

propulsion means for spinningly ejecting the top projectile from the firing chamber, the propulsion means comprising:

contact means for striking the projectile ejecting it spinning from the gun; and spring means for storing kinetic energy and suddenly releasing the energy to the contact means for causing the contact means to eject the projectile; and trigger means for imparting the kinetic energy to the spring means and for initiating release of the energy from the spring means, wherein the firing chamber comprises a space between a retainer member and a top edge of the magazine, the space formed by a spacer disposed between the retainer member and the magazine.

3. The toy gun of claim 2, wherein the magazine comprises:

a hollow cylindrical magazine body having a closed end, sidewalls substantially perpendicular to the closed end, and an open end;

a traveler piston within the magazine body for moving a top projectile of a stack of projectiles into the firing chamber; and a spring disposed between the closed end of the magazine body and the traveler piston for pushing the traveler piston.

4. The toy gun of claim 2, wherein the firing chamber is formed by two retainer members spaced apart laterally, said retainer members setting a maximum projectile thickness.

5. The toy gun of claim 2, wherein the propulsion means comprises:

contact means being a propulsion lever disposed to strike a side edge of the top projectile expelling the top projectile from the firing chamber, an end of the propulsion lever striking the edge of the top projectile being angled for imparting a spin to the projectile; and spring means being a main spring disposed within the body and engaging the propulsion lever for moving the propulsion lever to strike the top projectile.

6. The toy gun of claim 2 wherein the barrel of said gun includes an aperture along a lower surface thereof, and wherein said magazine is partially mounted within said aperture when operably connected thereto and wherein said magazine depends from said barrel along said lower surface such that a majority of said magazine is external to said gun body.

7. The toy gun of claim 6 wherein said magazine comprises two circular notches on opposite sides of said magazine, said notches adapted to cooperate with slots on said gun body to removably mount said magazine within said gun.

8. A toy gun for propelling disk-shaped projectiles of varying thicknesses, the gun comprising:

a hollow gun body of a gun-like shape having a barrel with an open end and a handle for grasping the gun;

a removable magazine for sequentially dispensing a plurality of disk-shaped projectiles into a firing chamber, the magazine sized to fit and insertable into an aperture in the gun body, said firing chamber setting the maximum thickness of said disk-shaped projectile;

a transparent window fixedly mounted to the gun body at an upper surface of the barrel to allow a user to view a major portion of the top projectile in the firing chamber, said transparent window positioned over said magazine and sized to be larger than the projectile's exposed surface area such that an entire projectile can be seen through the transparent window except for the portions of the projectile covered by the magazine;

a propulsion lever disposed to strike a side edge of the projectile for expelling it from the firing chamber and out of the gun through the barrel, an end of the propulsion lever which strikes the edge of the projectile being angled for imparting a spin to the projectile;

a main spring disposed within the body and engaging the propulsion lever for imparting energy to the propulsion lever for striking the projectile;

a trigger depending from the gun body in a position to be pulled by a finger of a hand grasping the gun, the trigger for sequentially storing energy in the main spring and releasing the main spring so the main spring can energize the propulsion lever;

a cocking lever operationally connected to the trigger for capturing the main spring within a notch of the cocking lever and for moving the main spring and the engaged propulsion lever rearward away from the magazine when the trigger is pulled, thereby energizing the main spring;

a return band for reinming the trigger when it is no longer being pulled and for canting the cocking lever to ensure capture of the main spring; and an inclined plane attached to an interior surface of the gun body for releasing the main spring from the notch by displacing the cocking lever against the pull of the return band, thereby causing the main spring to release energy by to move rapidly forward towards the magazine carrying the engaged propulsion lever with it, the propulsion lever striking the projectile in the firing chamber, propelling it spinning from the open end of the barrel.

9. The toy gun of claim 8, wherein the firing chamber is part of the removable magazine, said magazine comprising:

a hollow cylindrical magazine body having a closed end, sidewalls substantially perpendicular to the closed end, and an open end;

a firing chamber formed between the open end of the magazine body and two planar retainer members spaced apart to reveal the central portion of the top projectile and attached to the sidewalls at the open end and spaced a distance apart from the open end approximately a thickness of the projectile, said planar retainer members adapted to retain said disk-shaped projectiles in said magazine;

a traveler piston within the magazine body for moving a top projectile of a stack of the projectiles into the firing chamber; and a spring disposed between the closed end of the magazine body and the traveler piston for pushing the traveler pistons.

10. A toy gun for propelling disk-shaped projectiles, the gun comprising:

a hollow gun body having a barrel with an open end and a handle for grasping the gun;

a magazine removably attachable to the gun for sequentially dispensing disk-shaped projectiles into the gun;

a firing chamber occupied by a disk-shaped top projectile when a loaded magazine is attached to the gun, the firing chamber formed by two retainer members spaced apart laterally and comprising a space between the retainer members and a top edge of the magazine formed by a spacer disposed between the retainer member and the top edge, said retainer members adapted to retain said disk-shaped projectiles in said magazine;

a transparent window fixedly mounted to the gun body at an upper surface of the barrel to allow a user to view a major portion of the top projectile in the firing chamber, said transparent window positioned over said magazine and sized to be larger than the projectile's exposed surface area such that the entire projectile can be seen through the transparent window except for the portions of the projectile covered by the planar retaining member;

propulsion means for spinningly ejecting the top projectile from the firing chamber, the propulsion means comprising:

contact means for striking the projectile ejecting it spinning from the gun; and spring means for storing kinetic energy and suddenly releasing the energy to the contact means for causing the contact means to eject the projectile;

trigger means for imparting the kinetic energy to the spring means and for initiating release of the energy from the spring means.

11. A toy gun for propelling disk-shaped projectiles of variable thicknesses, the gun comprising:

a hollow gun body having a barrel with an open end and a handle for grasping the gun;

a magazine removably attachable to the gun for sequentially dispensing disk-shaped projectiles into the gun;

a firing chamber occupied by a disk-shaped top projectile when a loaded magazine is attached to the gun, dimensions of said firing chamber defining the maximum size of the top projectile and leaving a central portion of the top projectile uncovered;

a transparent window fixedly mounted to the gun body at an upper surface of the barrel to allow a user to view a major portion of the top projectile in the firing chamber, said transparent window positioned over said magazine and sized to be larger than the projectile's exposed surface area such that the entire projectile can be seen through the transparent window except for the portions of the projectile covered by the planar retaining member;

propulsion means for spinningly ejecting the top projectile from the firing chamber, the propulsion means comprising:

contact means for striking the projectile ejecting it spinning from the gun including a propulsion lever disposed to strike a side edge of the top projectile expelling the top projectile from the firing chamber, an end of the propulsion lever striking the edge of the top projectile being angled for imparting a spin to the projectile;

spring means for storing kinetic energy and suddenly releasing the energy to the contact means for causing the contact means to eject the projectile including a main spring disposed within the gun body and engaging the propulsion lever for moving the propulsion lever to strike the top projectile; and trigger means for imparting the kinetic energy to the spring means and for initiating release of the energy from the spring means.

12. The toy gun of claim 11, wherein the trigger means comprises:

a trigger depending from the gun body in a position to be pulled by a finger of a hand grasping the handle of the body;

a cocking lever operationally connected to the trigger and capturing the main spring within a notch of the cocking lever for moving the main spring and the engaged propulsion lever rearward away from the magazine when the trigger is pulled; and an inclined plane attached to an interior surface of the body for releasing the main spring from the notch by displacing the cocking lever, thereby causing the propulsion lever to move rapidly forward towards the magazine striking the top projectile in the firing chamber propelling it spinning from the open end of the barrel.

* * * * *